US009187299B2

(12) United States Patent
Yang

(10) Patent No.: US 9,187,299 B2
(45) Date of Patent: Nov. 17, 2015

(54) JACK STRUCTURE

(71) Applicant: Chung-Yi Yang, New Taipei (TW)

(72) Inventor: Chung-Yi Yang, New Taipei (TW)

( * ) Notice: Subject to any disclaimer, the term of this patent is extended or adjusted under 35 U.S.C. 154(b) by 175 days.

(21) Appl. No.: 14/081,380

(22) Filed: Nov. 15, 2013

(65) Prior Publication Data

US 2015/0137056 A1 May 21, 2015

(51) Int. Cl.
*B66F 3/24* (2006.01)
*B66F 3/26* (2006.01)

(52) U.S. Cl.
CPC ..... *B66F 3/26* (2013.01)

(58) Field of Classification Search
CPC ..... B66F 3/26; B66F 3/36; B66F 3/24; B66F 7/08; B66F 7/085; B66F 7/16; B66F 9/04; B66F 2700/126; B25B 1/02; B25B 1/106; B25B 1/20
USPC ..... 269/43, 32, 24–27, 291
See application file for complete search history.

(56) References Cited

U.S. PATENT DOCUMENTS 8,944,157 B2 * 2/2015 Mail ..... B66B 9/04 166/383

* cited by examiner

*Primary Examiner* — Monica Carter
*Assistant Examiner* — Nirvana Deonauth
(74) *Attorney, Agent, or Firm* — WPAT, P.C.; Anthony King; Kay Yang

(57) ABSTRACT

A jack structure includes a cylinder, an air chamber piston rod disposed therein, an ejection piston rod disposed around the air chamber piston rod, a position-limiting component on top of the external cylinder, and a fastening component on top of the cylinder. The air chamber piston rod has a top with an air chamber piston, an internal portion with a first air chamber, and a sidewall with a gas passage in communication with the first air chamber. The ejection piston rod has an air chamber sealing cover, position-limiting portion, and ejection hydraulic piston. The air chamber sealing cover, ejection piston rod, air chamber piston rod, and air chamber piston together define a second air chamber communicating with the first air chamber. The ejection hydraulic piston, ejection piston rod, air chamber sealing cover, air chamber piston rod, and cylinder together define a hydraulic chamber communicating with the liquid passage.

8 Claims, 7 Drawing Sheets

JACK STRUCTURE

FIELD OF THE INVENTION

The present invention relates to jacks, and more particularly, to a jack structure operable both pneumatically and hydraulically and conducive to reducing internal pipeline congestion and thereby preventing the jack structure from damage.

BACKGROUND OF THE INVENTION

After a user has lifted a heavy load with the ejection spindle of a conventional hydraulic jack, the ejection spindle takes much time descending to its initial position.

Furthermore, an oily liquid for use in the hydraulic pipeline inside the jack is susceptible to contamination, and thus the hydraulic pipeline inside the jack is prone to congestion which blocks the passage of the oily liquid, thereby rendering the jack inoperable.

Furthermore, if the hydraulic pipeline is clogged and the user keeps feeding the oily liquid into the jack, not only will the jack become inoperable, but the jack will also get damaged because of the difference in the cross-sectional area between a slave cylinder and a master cylinder of the jack.

Referring to FIG. 1, unlike the aforesaid conventional hydraulic jack, a conventional double-acting jack is characterized by an oil feeding hole 1 through which oil is fed to a primary oil chamber 2 in order to elevate an ejection spindle 3 of the double-acting jack. Referring to FIG. 2, oil is fed via a descent oil route 4 to a secondary oil chamber 5 disposed in the ejection spindle 3, so as to lower the ejection spindle 3. The conventional double-acting jack is advantageously characterized in that the ejection spindle 3 of the double-acting jack is capable of quick restoration to its initial position. However, the conventional double-acting jack has the following drawbacks: the primary oil chamber 2 has a much larger cross-sectional area than the secondary oil chamber 5 such that, due to the large difference in the resultant pressure between the primary and secondary oil chambers 2, 5, over-compression is likely to occur to thereby damage the double-acting jack whenever the hydraulic pipeline in the double-acting jack is clogged and the user keeps feeding oil to the primary oil chamber 2 or the secondary oil chamber 5.

Accordingly, it is imperative to provide a jack conducive to reduction in the likelihood of pipeline congestion and over-compression and conducive to quick restoration to its initial condition.

SUMMARY OF THE INVENTION

In order to achieve the above and other objectives, the present invention provides a jack structure conducive to reducing internal pipeline congestion and thereby reducing the chance that over-compression occurs.

Another objective of the present invention is to provide a jack structure conducive to quick restoration to its initial condition.

In order to achieve the above and other objectives, the present invention provides a jack structure which comprises an external cylinder, an air chamber piston rod, an air chamber piston, an ejection piston rod, an ejection hydraulic piston, a position-limiting component and a fastening component.

The external cylinder has a liquid passage and is penetratingly disposed at a sidewall of the external cylinder.

The air chamber piston rod is disposed centrally in the external cylinder and has: a first air chamber disposed in the air chamber piston rod; a gas orifice penetratingly disposed at the bottom of the air chamber piston rod, wherein a gas is conveyed to the first air chamber via the gas orifice; a sealing component for hermetically sealing the gas orifice; and a gas passage penetratingly disposed at a sidewall of the air chamber piston rod and communicating with the first air chamber.

The air chamber piston is disposed at the top of the air chamber piston rod.

The ejection piston rod is disposed movably around the air chamber piston rod and has: a jack platform disposed at the top of the ejection piston rod; and an air chamber sealing cover disposed at the bottom of an internal wall of the ejection piston rod, wherein the air chamber sealing cover, the internal wall of the ejection piston rod, an external wall of the air chamber piston rod, and the air chamber piston together define a second air chamber, and the second air chamber is in communication with the first air chamber via the gas passage; an ejection hydraulic piston disposed at the bottom of an external wall of the ejection piston rod, wherein the ejection hydraulic piston, the bottom of the ejection piston rod, the air chamber sealing cover, the external wall of the air chamber piston rod, an internal wall of the external cylinder together define a hydraulic chamber, and the hydraulic chamber is in communication with the liquid passage; and a position-limiting portion disposed at the bottom of the external wall of the ejection piston rod and above the ejection hydraulic piston.

The position-limiting component is disposed at the top of the external cylinder, corresponds in position to the position-limiting portion, and is adapted to confine the ejection hydraulic piston of the ejection piston rod to between the position-limiting component and the bottom of an internal portion of the external cylinder.

The fastening component is disposed at the top of the external cylinder, disposed above the position-limiting component, and fastened to the external wall of the ejection piston rod.

The air chamber sealing cover and the external wall of the air chamber piston rod are in airtight sliding contact. The air chamber piston and the internal wall of the ejection piston rod are in airtight sliding contact. The ejection hydraulic piston and the internal wall of the external cylinder are in fluid-tight sliding contact.

As regards the jack structure, the gas passage is positioned proximate to the top of the air chamber piston rod and disposed below the air chamber piston.

As regards the jack structure, the liquid passage is positioned proximate to the bottom of the external cylinder.

As regards the jack structure, the external wall of the ejection piston rod further has a thread structure disposed above the position-limiting portion.

The jack structure further comprises a thread component disposed between the position-limiting component and the fastening component and corresponding in position to the thread structure of the ejection piston rod.

In conclusion, the jack structure of the present invention is conducive to reducing internal pipeline congestion, reducing the chance that over-compression occurs, and restoring the ejection piston rod to its initial position quickly.

BRIEF DESCRIPTION OF THE DRAWINGS

Objectives, features, and advantages of the present invention are hereunder illustrated with specific embodiments in conjunction with the accompanying drawings, in which.

DETAILED DESCRIPTION OF THE PREFERRED EMBODIMENTS

Figure 1:
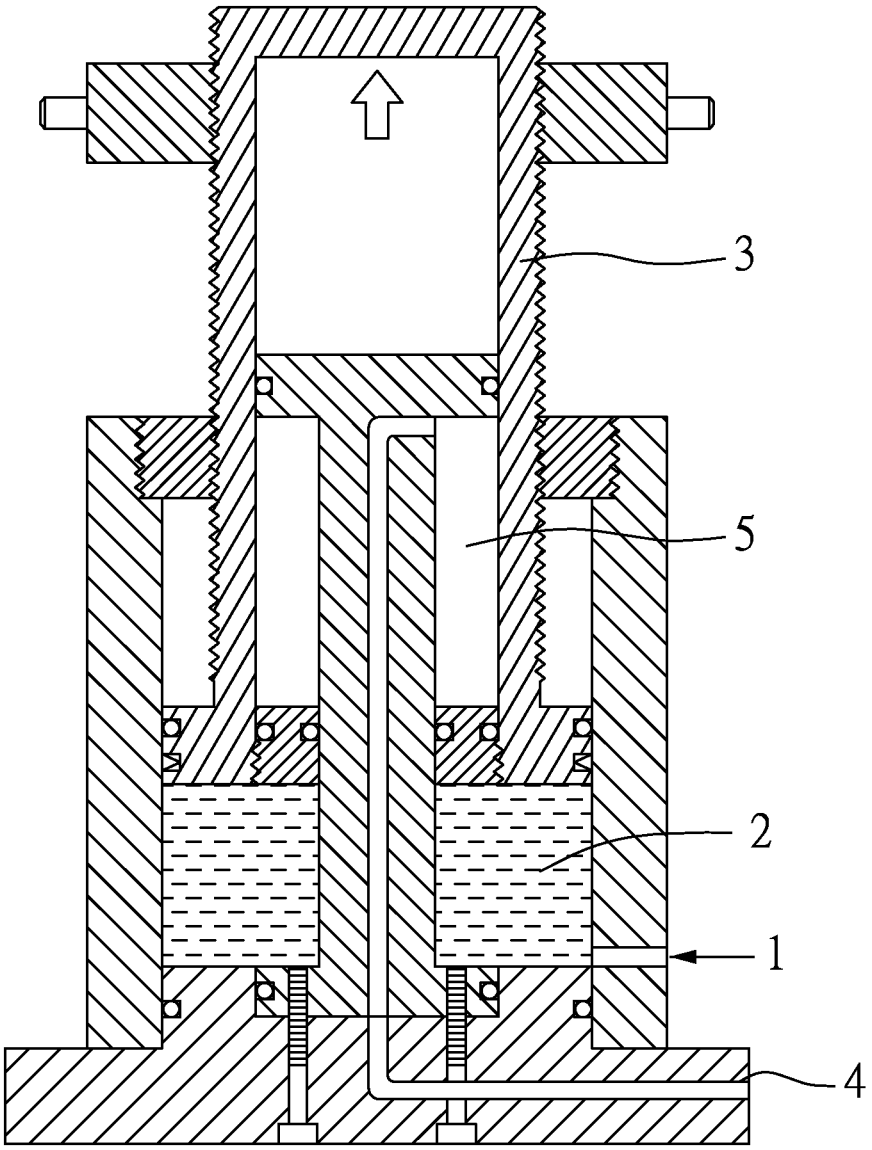
(PRIOR ART) FIG.1
FIG. 1 and FIG. 2 (PRIOR ART) are cross-sectional views of a conventional double-acting jack in operation.
Figure 2:
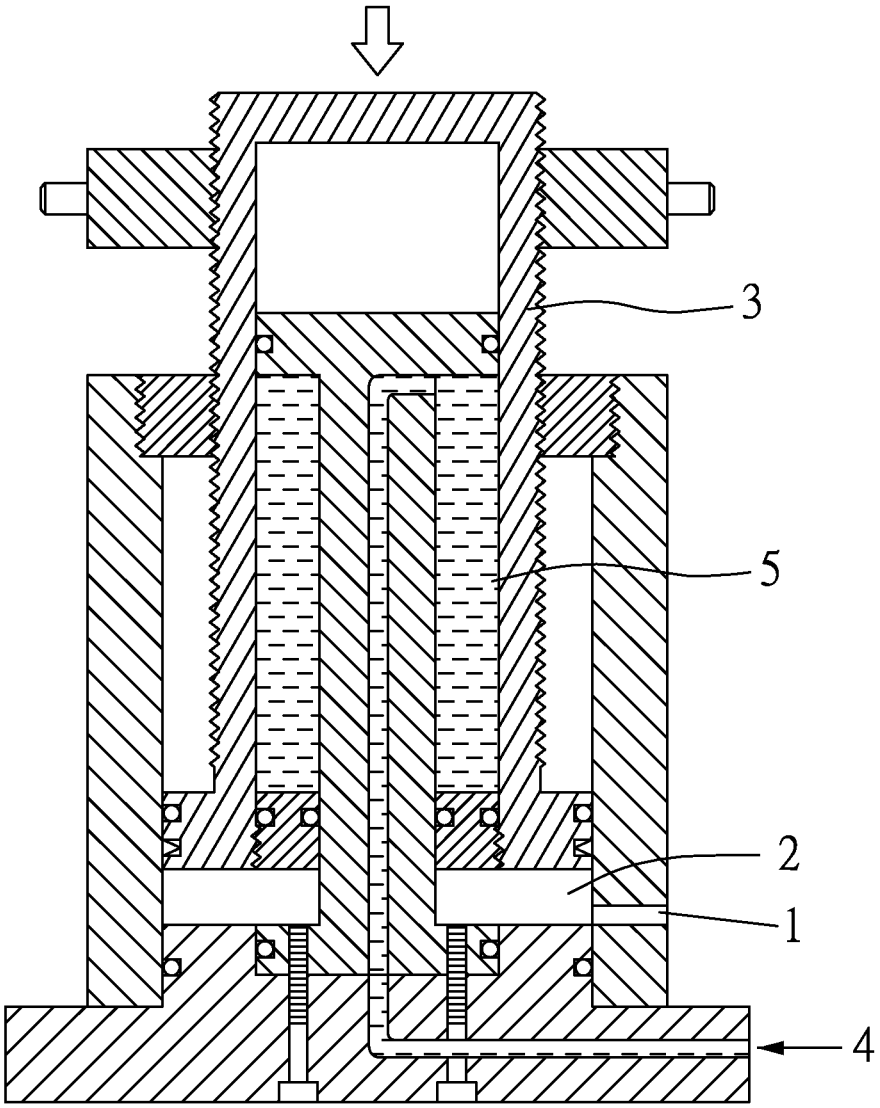
(PRIOR ART) FIG.2
Figure 3:
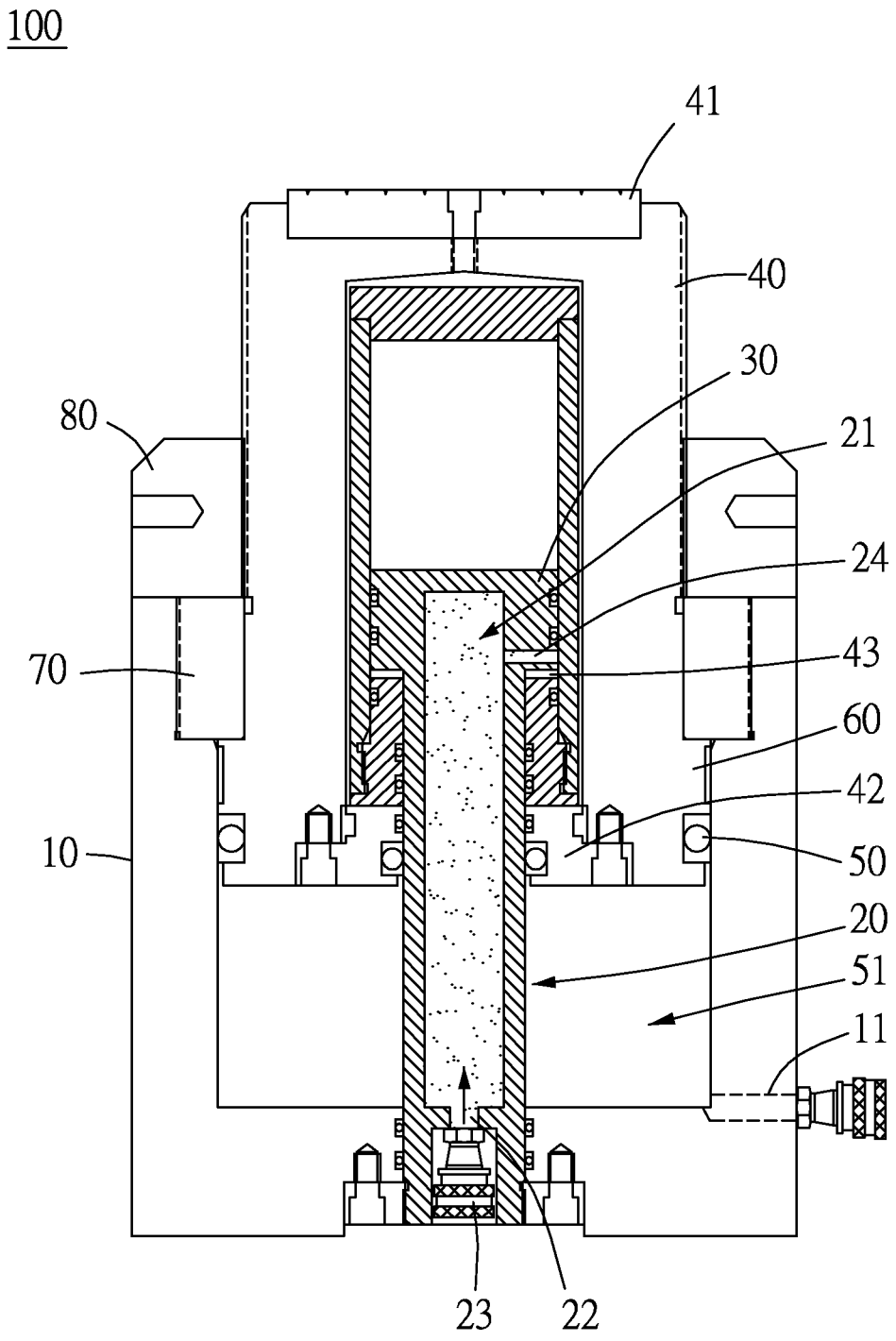
FIG. 3 is a schematic view of a jack structure according to the first embodiment of the present invention.

Referring to FIG. 3, there is shown a schematic view of a jack structure 100 according to the first embodiment of the present invention. As shown in the diagram, the jack structure 100 comprises an external cylinder 10, an air chamber piston rod 20, an air chamber piston 30, an ejection piston rod 40, an ejection hydraulic piston 50, a position-limiting portion 60, a position ting component 70, and a fastening component 80.

Referring to FIG. 3, the external cylinder 10 has a liquid passage 11 which penetrates the sidewall of the external cylinder 10, and the liquid passage 11 is preferably positioned proximate to the bottom of the external cylinder 10. In practice, the liquid passage 11 is connected to a liquid tank (not shown) and a hydraulic pump (not shown). The liquid tank contains a well-known liquid (not shown), such as oil or water.

The air chamber piston rod 20 is centrally disposed in the external cylinder 10. The air chamber piston rod 20 comprises a first air chamber 21, a gas orifice 22, a sealing component 23, and a gas passage 24. The first air chamber 21 is disposed in the air chamber piston rod 20. The gas orifice 22 is penetratingly disposed at the bottom of the air chamber piston rod 20 and connected to an atmospheric pump (not shown) to feed a gas to the first air chamber 21, wherein the present invention is not restrictive of the gas, though the gas can be air or a specific type of gas. The sealing component 23 is disposed at the gas orifice 22. Upon completion of the feeding of the gas to the first air chamber 21, the sealing component 23 hermetically seals the gas orifice 22. The gas passage 24 is penetratingly disposed at the sidewall of the air chamber piston rod 20 and is in communication with the first air chamber 21.

The air chamber piston 30 is disposed at the top of the air chamber piston rod 20. The air chamber piston 30 further comprises an airtight ring, such as an O-ring. Referring to FIG. 3, the gas passage 24 is preferably positioned proximate to the top of the air chamber piston rod 20 and disposed below the air chamber piston 30.

The ejection piston rod 40 is disposed movably around the air chamber piston rod 20 and disposed in the external cylinder 10. The ejection piston rod 40 has a jack platform 41 and an air chamber sealing cover 42. The jack platform 41 is disposed at the top of the ejection piston rod 40 and adapted to underpin a heavy load (not shown). The air chamber sealing cover 42 is disposed at the bottom of the internal wall of the ejection piston rod 40. The air chamber sealing cover 42 further comprises a sealing ring, such as an O-ring. The air chamber sealing cover 42, the internal wall of the ejection piston rod 40, the external wall of the air chamber piston rod 20, and the air chamber piston 30 together define a second air chamber 43.

The ejection hydraulic piston 50 is disposed at the bottom of the external wall of the ejection piston rod 40. The ejection hydraulic piston 50 further comprises a sealing ring, such as an O-ring. The ejection hydraulic piston 50, the bottom of the ejection piston rod 40, the air chamber sealing cover 42, the external wall of the air chamber piston rod 20, and the internal wall of the external cylinder 10 together define a hydraulic chamber 51. The hydraulic chamber 51 is in communication with the liquid passage 11.

The position-limiting portion 60 is disposed at the bottom of the external wall of the ejection piston rod 40 and disposed above the ejection hydraulic piston 50. Alternatively, the position-limiting portion 60 is part of the ejection hydraulic piston 50.

Figure 4:
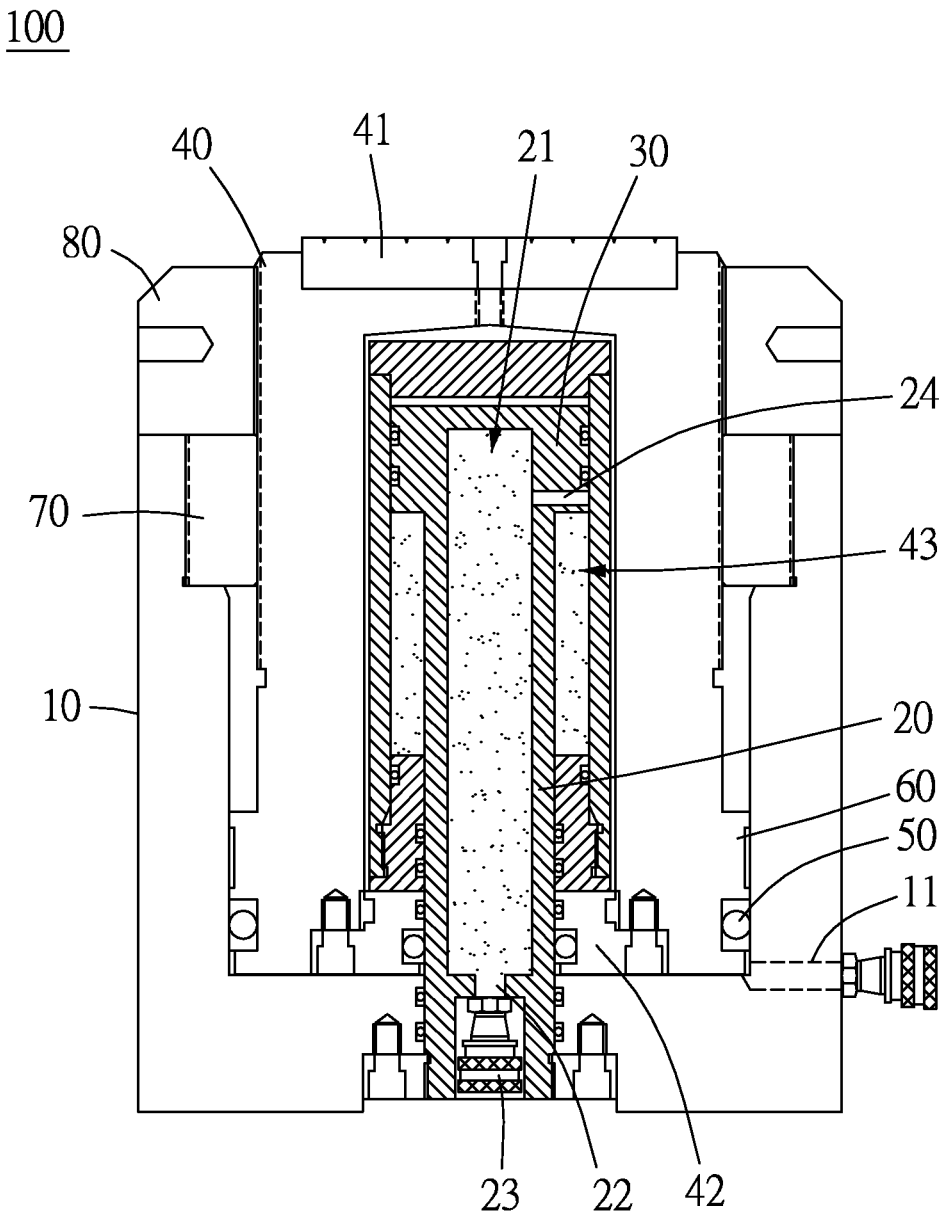
FIG. 4 is a schematic view of the jack structure according to the first embodiment of the present invention, showing that a first air chamber and a second air chamber of the jack structure are filled with gas.

Referring to FIG. 3 and FIG. 4, the second air chamber 43 is in communication with first air chamber 21 via the gas passage 24. The sealing component 23 enables the second air chamber 43 and the first air chamber 21 to jointly define a closed space.

The position-limiting component 70 is disposed at the top of the external cylinder 10 and corresponds in position to the position-limiting portion 60, such that the ejection hydraulic piston 50 is confined to a space defined by and between the position-limiting component 70 and the bottom of the internal portion of the external cylinder 10.

The fastening component 80 is disposed at the top of the external cylinder 10 and disposed above the position-limiting component 70. The fastening component 80 is fastened to the external wall of the ejection piston rod 40, such that the ejection piston rod 40 is fixed in place.

The air chamber sealing cover 42 is in airtight sliding contact with the external wall of the air chamber piston rod 20. The air chamber piston 30 is in airtight sliding contact with the internal wall of the ejection piston rod 40. The ejection hydraulic piston 50 is in fluid-tight sliding contact with the internal wall of the external cylinder 10.

Figure 5:
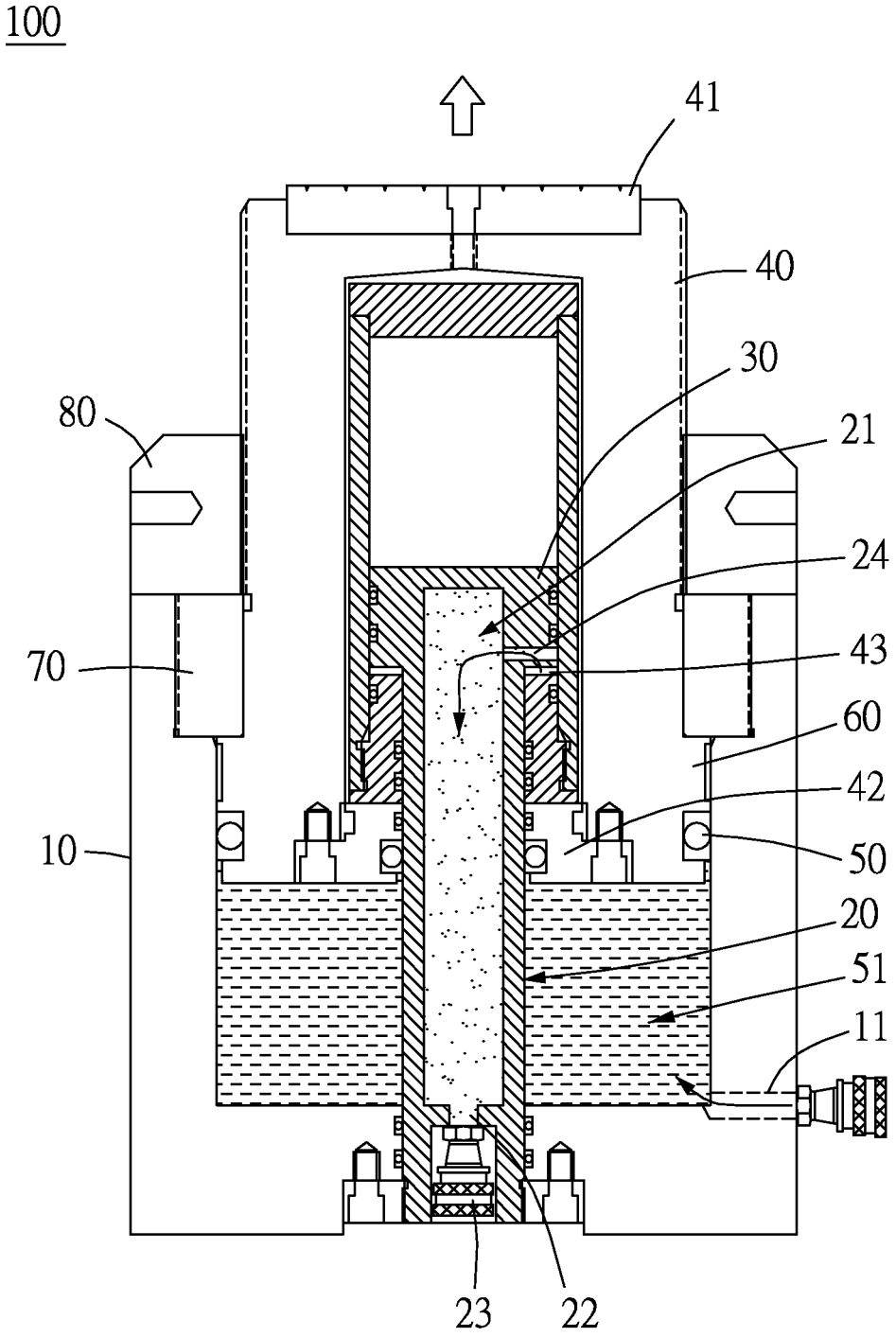
FIG. 5 is a schematic view of the jack structure filled with a liquid according to the first embodiment of the present invention.
Figure 6:
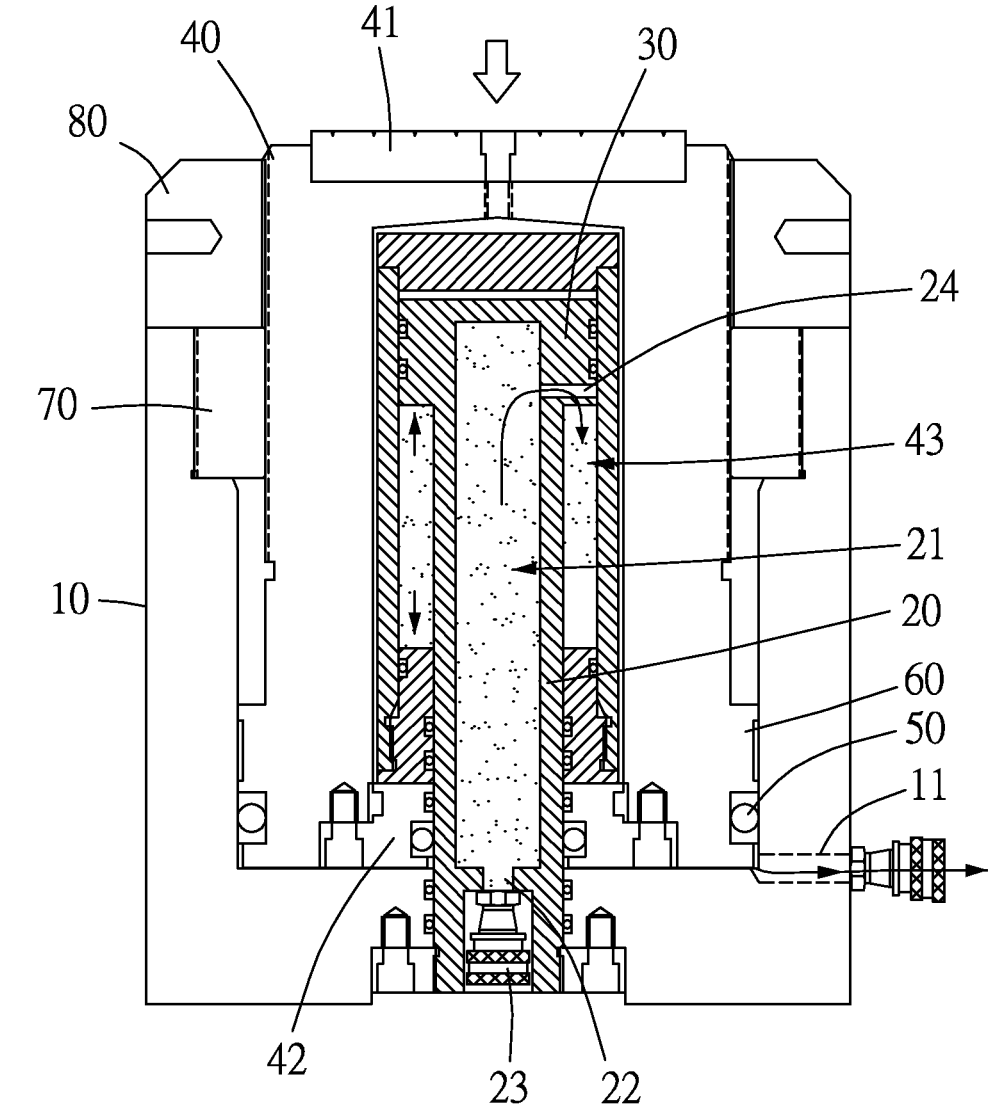
FIG. 6 is a schematic view of the jack structure according to the first embodiment of the present invention, showing that an ejection piston rod of the jack structure has been restored to its initial position.

Referring to FIG. 4 through FIG. 6, there are shown schematic views of the process of operation of the jack structure 100 according to the present invention.

Referring to FIG. 4, a user conveys a gas to the first air chamber 21 of the air chamber piston rod 20 through the gas orifice 22 of the air chamber piston rod 20, using an atmospheric pump. Then, the gas passes through the gas passage 24 to reach the second air chamber 43. Once a specific amount of the gas accumulates in the first air chamber 21 and the second air chamber 43, the sealing component 23 will hermetically seal the gas orifice 22, such that the first air chamber 21 and the second air chamber 43 together form a closed space. At this point in time, the bottom of the ejection piston rod 40 is positioned proximate to the bottom of the interior portion of the external cylinder 10, and the current position of the ejection piston rod 40 is defined as the "initial position" thereof.

Referring to FIG. 5, to lift the ejection piston rod 40, the user conveys a liquid from a liquid tank to the hydraulic chamber 51 via the liquid passage 11 of the external cylinder 10, using a hydraulic pump. As the liquid in the hydraulic chamber 51 accumulates gradually, the ejection piston rod 40 elevates gradually, thereby allowing the jack platform 41 to underpin a heavy load; meanwhile, the second air chamber 43 contracts, such that the gas therein is conveyed from the second air chamber 43 to the first air chamber 21 via the gas passage 24. Finally, the user fastens the fastening component 80 to the external wall of the ejection piston rod 40, such that the fastening component 80 abuts against the external wall of the ejection piston rod 40, not only allowing the ejection piston rod 40 to be fixed in place, but also keeping the jack platform 41 at a specific height. As the gas has been fully conveyed from the second air chamber 43 to the first air chamber 21, the internal pressure of the first air chamber 21 is greater than the internal pressure of the second air chamber 43. The difference in the internal pressure between the first air chamber 21 and the second air chamber 43 continues, because the fastening component 80 is fastened to the external wall of the ejection piston rod 40 to fix the ejection piston rod 40 in place.

The purpose of the position-limiting component 70 is to prevent the user from introducing too much liquid to the hydraulic chamber 51, thereby preventing the ejection piston rod 40 from escaping the external cylinder 10.

Referring to FIG. 6, the mechanism of lowering the ejection piston rod 40 to the "initial position" is depicted. The user unfastens the fastening component 80, such that the ejection piston rod 40 resumes its ability to move, and the aforesaid difference in internal pressure between the first air chamber 21 and the second air chamber 43 can continue no more. To this end, the gas in the first air chamber 21 starts returning to the second air chamber 43 via the gas passage 24 until the first air chamber 21 and the second air chamber 43 become equal in internal pressure. As a result, the second air chamber 43 expands, thereby allowing the ejection piston rod 40 to descend; meanwhile, the liquid is discharged from the hydraulic chamber 51 through the liquid passage 11.

Alternatively, before unfastening the fastening component 80, the user drains the hydraulic chamber 51 to allow the liquid to be discharged therefrom through the liquid passage 11.

The jack structure of the present invention is characterized in that the first air chamber, the gas passage, and the second air chamber are in communication with each other to enable the ejection piston rod to return to its "initial position" quickly.

Furthermore, the gas for controlling the ascent and descent of the ejection piston rod 40 of the jack structure 100 is confined to a closed space defined within the jack structure 100, and thus the gas is unlikely to be contaminated; hence, congestion is unlikely to occur to the first air chamber 21, the gas passage 24 and the second air chamber 43. Therefore, the disadvantageous situation where the jack gets inoperable due to congestion of the hydraulic pipeline inside the jack is unlikely to occur.

Figure 7:
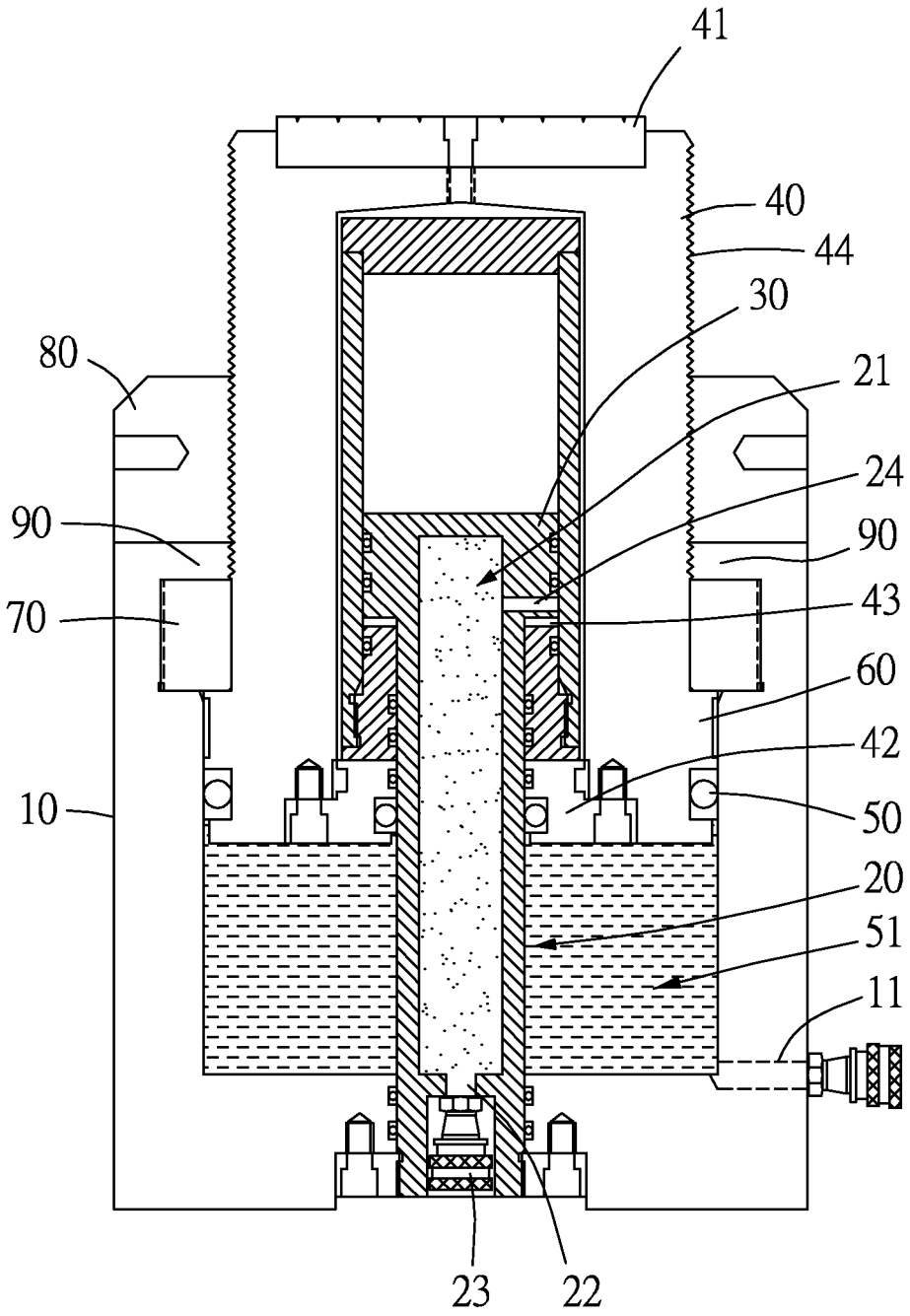
FIG. 7 is a schematic view of another jack structure according to the second embodiment of the present invention.

Referring to FIG. 7, there is shown a schematic view of a jack structure 200 according to the second embodiment of the present invention. The constituent elements of the jack structure 200 are substantially identical to the constituent elements of the jack structure 100. The external wall of the ejection piston rod 40 further has a thread structure 44 disposed above the position-limiting portion 60. The jack structure 200 further comprises a thread component 90 disposed between the position-limiting component 70 and the fastening component 80. The thread component 90 corresponds in position to the thread structure 44 of the ejection piston rod 40.

The thread component 90 and the thread structure 44 together enable the ejection piston rod 40 to ascend stepwise while the user is feeding the liquid to the hydraulic chamber 51.

In conclusion, the jack structures in the embodiments of the present invention are conducive to reduction in the likelihood of pipeline congestion, thereby reducing the chance that overcompression occurs, and are characterized in that the first air chamber, the gas passage and the second air chamber together enable the ejection piston rod to return to its "initial position" quickly. Furthermore, the jack structure in the second embodiment of the present invention is further advantageously characterized in that the thread component and the thread structure together enable stepwise ascent and descent of the ejection piston rod.

The present invention is disclosed above by preferred embodiments. However, persons skilled in the art should understand that the preferred embodiments are illustrative of the present invention only, but should not be interpreted as restrictive of the scope of the present invention. Hence, all equivalent modifications and replacements made to the aforesaid embodiments should fall within the scope of the present invention. Accordingly, the legal protection for the present invention should be defined by the appended claims.

What is claimed is:

1. A jack structure, comprising:

an external cylinder having a liquid passage penetratingly disposed at a sidewall of the external cylinder;

an air chamber piston rod disposed centrally in the external cylinder and having:

a first air chamber disposed in the air chamber piston rod;

a gas orifice penetratingly disposed at a bottom of the air chamber piston rod, wherein a gas is conveyed to the first air chamber via the gas orifice;

a sealing component for hermetically sealing the gas orifice; and a gas passage penetratingly disposed at a sidewall of the air chamber piston rod and communicating with the first air chamber;

an air chamber piston disposed at a top of the air chamber piston rod;

an ejection piston rod disposed movably around the air chamber piston rod and having:

a jack platform disposed at a top of the ejection piston rod; and an air chamber sealing cover disposed at a bottom of an internal wall of the ejection piston rod, wherein the air chamber sealing cover, the internal wall of the ejection piston rod, an external wall of the air chamber piston rod, and the air chamber piston together define a second air chamber, and the second air chamber is in communication with the first air chamber via the gas passage;

an ejection hydraulic piston disposed at a bottom of an external wall of the ejection piston rod, wherein the ejection hydraulic piston, a bottom of the ejection piston rod, the air chamber sealing cover, the external wall of the air chamber piston rod, an internal wall of the external cylinder together define a hydraulic chamber, and the hydraulic chamber is in communication with the liquid passage; and a position-limiting portion disposed at the bottom of the external wall of the ejection piston rod and above the ejection hydraulic piston, a position-limiting component disposed at a top of the external cylinder, corresponding in position to the position-limiting portion, and adapted to confine the ejection hydraulic piston of the ejection piston rod to between the position-limiting component and a bottom of an internal portion of the external cylinder; and a fastening component disposed at the top of the external cylinder, disposed above the position-limiting component, and fastened to the external wall of the ejection piston rod, wherein the air chamber sealing cover and the external wall of the air chamber piston rod are in airtight sliding contact, the air chamber piston and the internal wall of the ejection piston rod are in airtight sliding contact, whereas the ejection hydraulic piston and the internal wall of the external cylinder are in fluid-tight sliding contact.

2. The jack structure of claim 1, wherein the external wall of the ejection piston rod further has a thread structure disposed above the position-limiting portion, and the jack structure further comprises a thread component disposed between the position-limiting component and the fastening component and corresponding in position to the thread structure of the ejection piston rod.

3. The jack structure of claim 1, wherein the gas passage is positioned proximate to the top of the air chamber piston rod and disposed below the air chamber piston.

4. The jack structure of claim 3, wherein the external wall of the ejection piston rod further has a thread structure disposed above the position-limiting portion, and the jack structure further comprises a thread component disposed between the position-limiting component and the fastening component and corresponding in position to the thread structure of the ejection piston rod.

5. The jack structure of claim 3, wherein the liquid passage is positioned proximate to a bottom of the external cylinder.

6. The jack structure of claim 5, wherein the external wall of the ejection piston rod further has a thread structure disposed above the position-limiting portion, and the jack structure further comprises a thread component disposed between the position-limiting component and the fastening component and corresponding in position to the thread structure of the ejection piston rod.

7. The jack structure of claim 1, wherein the liquid passage is positioned proximate to a bottom of the external cylinder.

8. The jack structure of claim 7, wherein the external wall of the ejection piston rod further has a thread structure disposed above the position-limiting portion, and the jack structure further comprises a thread component disposed between the position-limiting component and the fastening component and corresponding in position to the thread structure of the ejection piston rod.

* * * * *